US006045388A

United States Patent [19]

Higgins et al.

[11] Patent Number: 6,045,388

[45] Date of Patent: Apr. 4, 2000

[54] ELECTRICAL CONNECTOR POSITION ASSURANCE SYSTEM

[75] Inventors: Michael Patrick Higgins, Berwyn; Clarence Robert Moon, III, Joliet; Anthony J. Pill, Aurora, all of Ill.

[73] Assignee: Molex Incorporated, Lisle, Ill.

[21] Appl. No.: 09/145,892

[22] Filed: Sep. 2, 1998

[51] Int. Cl.[7] ..... H01R 13/73

[52] U.S. Cl. ..... 439/352; 439/489

[58] Field of Search ..... 439/352, 350, 439/353, 357, 489

[56] References Cited

U.S. PATENT DOCUMENTS

| | | | |
|---|---|---|---|
| 4,634,204 | 1/1987 | Detter et al. . | |
| 4,708,413 | 11/1987 | Schroeder | 439/358 |
| 4,801,275 | 1/1989 | Ikeda et al. | 439/350 |
| 5,234,356 | 8/1993 | Maejima et al. | 439/352 |
| 5,330,369 | 7/1994 | Nozaki et al. | 439/489 |
| 5,507,666 | 4/1996 | Yamanashi | 439/489 |
| 5,628,648 | 5/1997 | Higgins, Jr. et al. | 439/489 |
| 5,628,649 | 5/1997 | Yagi et al. | 439/489 |
| 5,643,003 | 7/1997 | Myer et al. | 439/352 |
| 5,672,073 | 9/1997 | Matsumura et al. | 439/489 |
| 5,681,178 | 10/1997 | Kunkle et al. | 439/352 |
| 5,688,142 | 11/1997 | Dietz et al. | 439/487 |
| 5,839,915 | 11/1998 | Ford et al. | 439/489 |
| 5,879,180 | 3/1999 | Iwahori et al. | 439/352 |
| 5,910,027 | 6/1999 | Wayt et al. | 439/352 |

*Primary Examiner*—Lincoln Donovan
*Assistant Examiner*—Hae Moon Hyeon
*Attorney, Agent, or Firm*—Stacey E. Caldwell

[57] ABSTRACT

A connector position assurance system is provided for an electrical connector adapted for mating with another mateable connecting device. The connector includes a housing having a guideway and a stop surface near the guideway. A primary flexible locking arm on the housing includes a latch for mechanically interlocking with a cooperating latch of the mateable connecting device. A connector position assurance (CPA) device is slidable along the guideway between a first position allowing movement of the locking arm and mating of the connector with the mateable connecting device, and a second position blocking movement of the locking arm away from a latched position. The CPA device includes a flexible stop arm engageable with the stop surface on the housing to prevent the CPA device from moving from its first to its second position. The mateable connecting device includes an actuator for moving the flexible stop arm of the CPA device out of engagement with the stop surface automatically when the connector is fully mated with the mateable connecting device, thereby allowing movement of the CPA device from its first position to its second position indicating full mating of the connector.

8 Claims, 7 Drawing Sheets

ELECTRICAL CONNECTOR POSITION ASSURANCE SYSTEM

FIELD OF THE INVENTION

This invention generally relates to the art of electrical connectors and, particularly, to a connector position assurance system for an electrical connector adapted to mate with another mateable connecting device.

BACKGROUND OF THE INVENTION

Electrical connectors normally require secure mechanical and electrical engagement between one electrical connector and a mateable electrical connector or other mateable connecting device. Various latching systems have been used with electrical connectors to provide such secure engagement. Such systems usually provide this secure engagement with ease of attachment and detachment. For instance, latching mechanisms have been developed which include pivotally supported latch arms that interlock with each other or that interlock with a complementary latching mechanism of the mateable connector or connecting device.

In addition, connector position assurance devices also are known in the art. Typically, the primary function of such devices is to verify that the connectors are fully mated and latched, i.e. that the latching mechanisms are fully or securely engaged. A secondary function often is to prevent the latching mechanisms from inadvertently unlatching and permitting the connectors to separate. These connector position assurance functions may be accomplished in a variety of ways, but most prior art connector position assurance systems employ a spacer that cannot be inserted into its intended position unless the latching arm is fully engaged, and the latching arm cannot be moved when the spacer is properly positioned. Problems often are encountered with such removable spacers because they may be lost or misplaced. Therefore, in some position assurance systems, the spacers may be preloaded on the connector housing. However, one of the problems with such systems is that, should the preloaded spacer be inadvertently moved to its final locking position before the connectors are mated, mating cannot take place.

The present invention is directed to solving these problems and satisfying a need for an improved connector position assurance system.

SUMMARY OF THE INVENTION

An object, therefore, of the invention is to provide a new and improved connector position assurance system for an electrical connector adapted to mate with another mateable connecting device.

In the exemplary embodiment of the invention, an electrical connector includes a housing having a guideway and at least one stop surface near the guideway. A primary flexible locking arm is pivoted on the housing and includes a latch for mechanically interlocking with a cooperating latch of the mateable connecting device. A connector position assurance (CPA) device is slidably mounted on the housing for movement along the guideway between a first position allowing movement of the locking arm and mating of the connector with the mateable connecting device and a second position blocking movement of the locking arm away from a latched position. The CPA device includes a flexible stop arm engageable with the stop surface on the housing to prevent the CPA device from moving from its first to its second position. The mateable connecting device includes an actuator for moving the flexible stop arm of the CPA device out of engagement with the stop surface automatically when the connector is fully mated with the mateable connecting device. Thereby, the CPA device is allowed to move from its first position to its second position indicating full mating of the connector.

As disclosed herein, the primary flexible locking arm is pivoted to the housing on a fulcrum between a latch end and a rear end of the locking arm. The guideway comprises a pair of guide rails, between which the CPA device slides, each guide rail including one of the stop surfaces. The CPA device is generally E-shaped to include a pair of outside legs and a center leg. The outside legs comprise a pair of the flexible stop arms engageable with the two stop surfaces of the pair of guide rails. The mateable connecting device includes a pair of actuators for moving the stop arms out of engagement with the stop surfaces. The center leg of the E-shaped CPA device extends from a blocking surface which is movable beneath the rear end of the primary locking arm when the CPA device is in its second position to prevent flexing of the front latch end of the locking arm.

Other features of the invention include an enlarged flange on the CPA device for grasping by a user to facilitate manual manipulation of the CPA device and movement thereof between its positions. The center leg of the E-shaped CPA device includes detents engageable with the rear end of the primary locking arm to define the first and second positions of the CPA device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
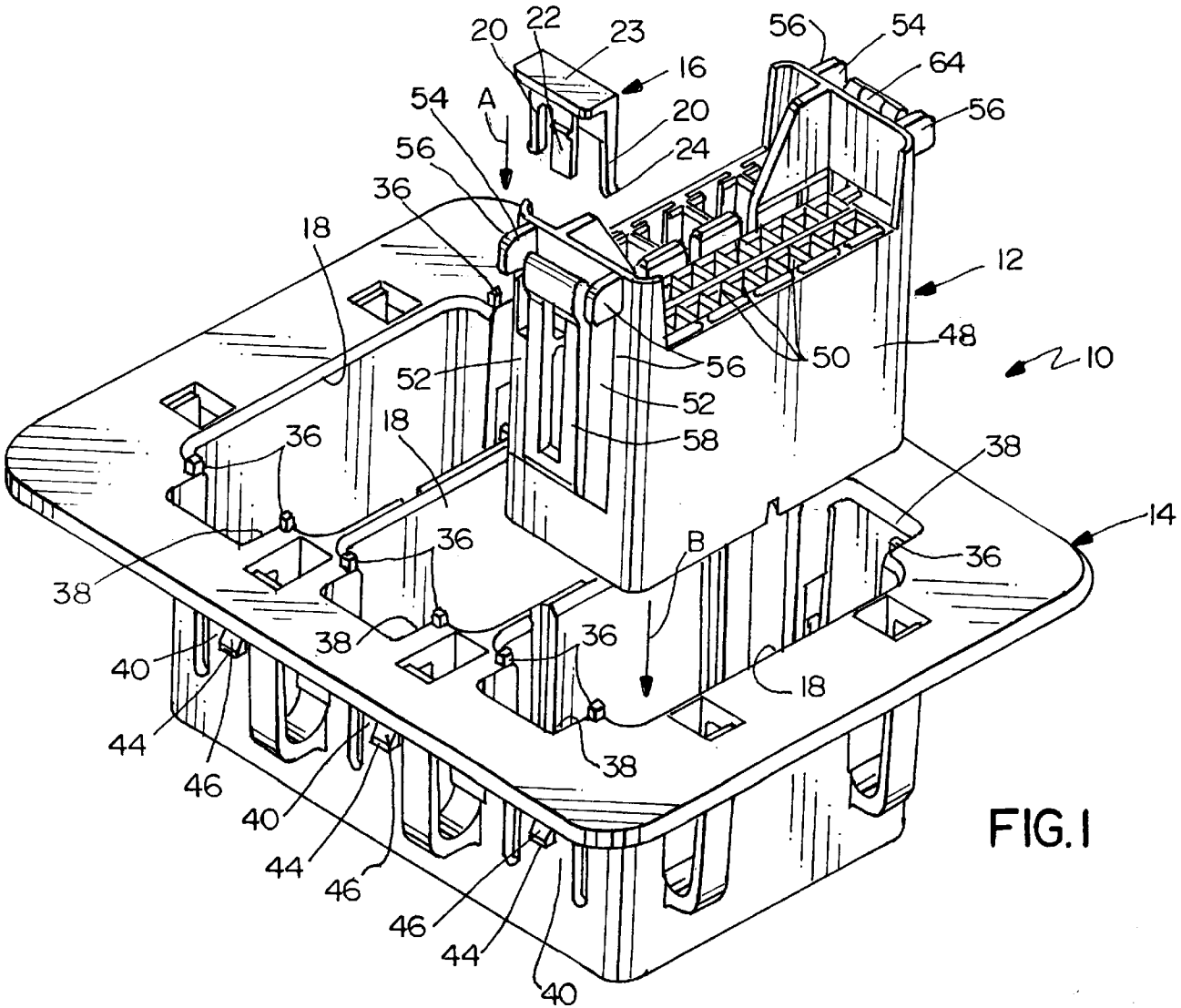
FIG. 1 is a perspective view of a connector assembly embodying the connector position assurance system of the invention.

Referring to the drawings in greater detail, and first to FIG. 1, the connector position assurance system of the invention is disclosed in an electrical connector assembly, generally designated 10, which includes an electrical connector, generally designated 12, adapted for mating with another mateable connecting device, generally designated 14. A connector position assurance (CPA) device, generally designated 16, is mounted on each opposite site of connector 12 in the direction of arrow "A". Only one of the CPA devices is shown in the drawings. Mateable connecting device 14 is a mateable connecting receptacle structure having a plurality (three) of receptacles 18. Although only one connector 12 is shown in the drawings, one of the connectors is inserted into each receptacle 18 in the direction of arrow "B".

Figure 2:
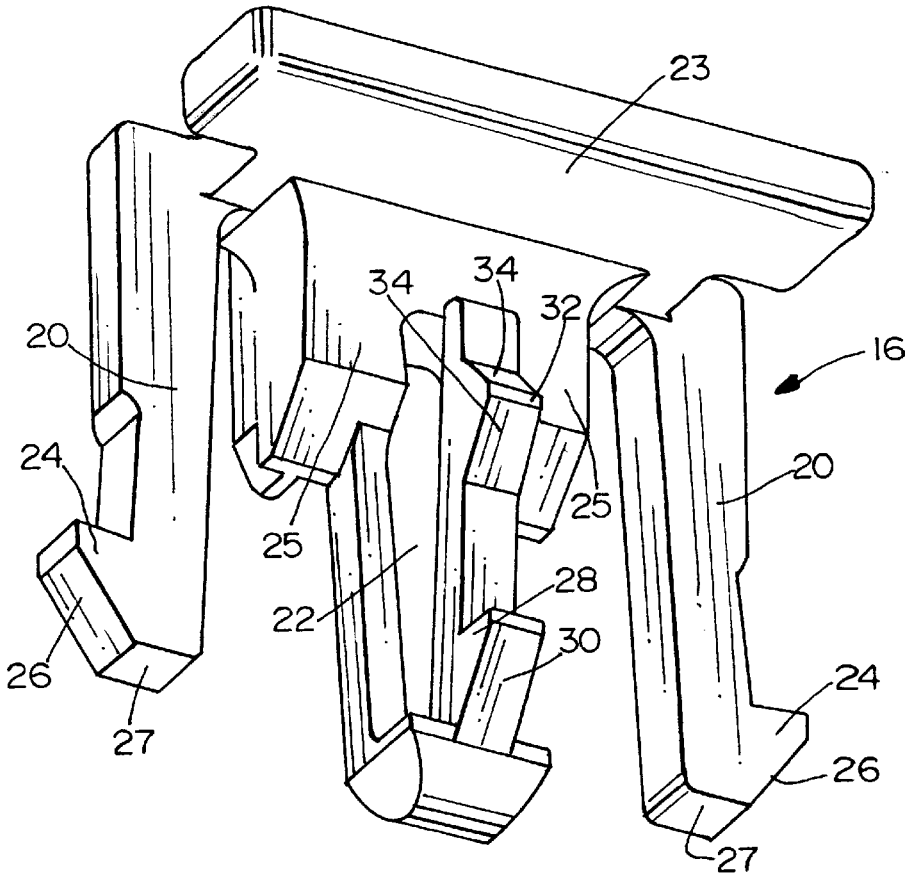
FIG. 2 is a front perspective view of the CPA device.
Figure 3:
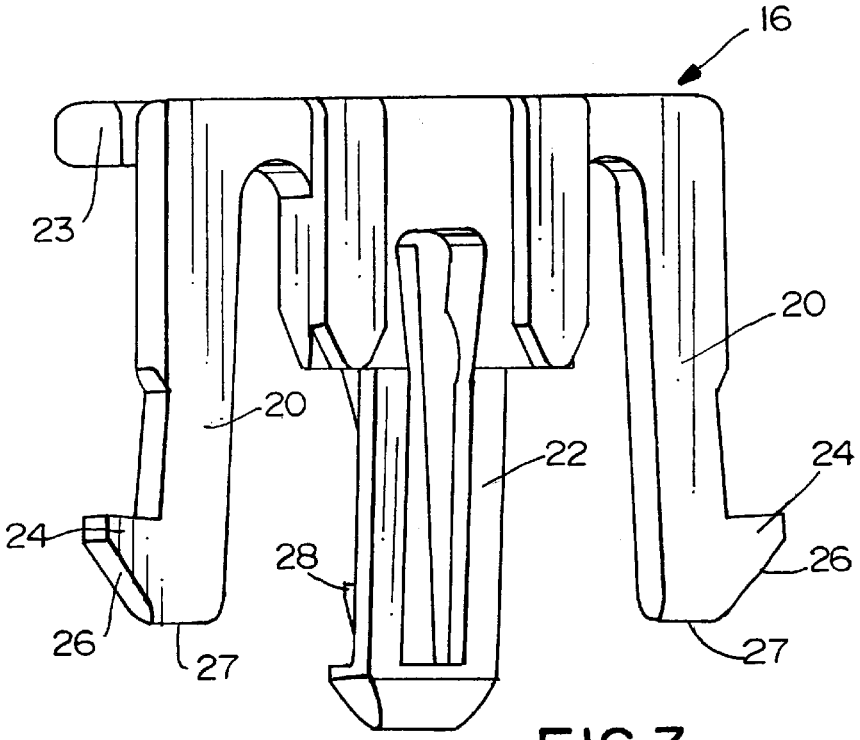
FIG. 3 is a rear perspective view of the CPA device.

Before proceeding with a description of connector 12 and receptacle device 14, reference first is made to FIGS. 2 and 3 which show CPA device 16. The device is generally E-shaped to define a pair of outside legs 20 and a center leg 22 joined by a cross portion 23 which defines an enlarged flange for grasping by a user to manually manipulate and move the CPA device. Each outside leg 20 includes an outwardly directed latch hook 24 having a forwardly facing angled or chamfered surface 26. The outside legs have blunt distal ends 27. Center leg 22 extends from a central blocking surface 25 and includes a latch hook 28 with an angled or chamfered surface 30, along with a raised boss 32 having chamfered surfaces 34 on opposite sides thereof. As will be seen hereinafter, latch hook 28 and raised boss 32 form detents which define respective positions of the CPA device on connector 12.

Figure 4:
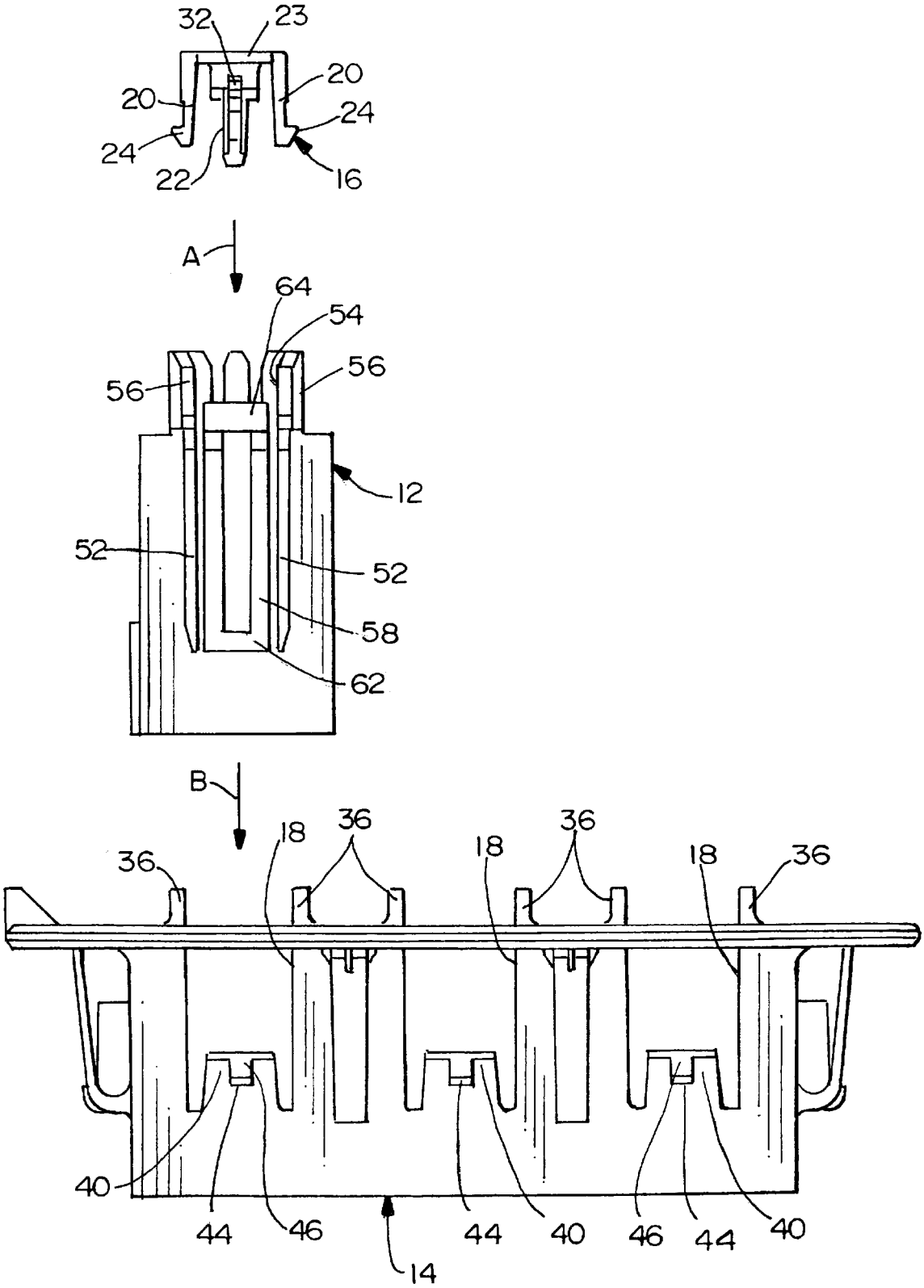
FIG. 4 is an exploded side elevational view of the CPA device, electrical connector and mateable connecting receptacle.

Referring to FIG. 4 in conjunction with FIG. 1, mateable connecting device 14 has a pair of actuator posts 36 at opposite sides of a recessed area 38 at each opposite end of each receptacle 18. The connecting device may be a one-piece structure unitarily molded of plastic material or the like. A cut-out wall 40 is located at each opposite end of each receptacle 18 so as to be somewhat flexible in relation to a more rigid side wall 42 of the connecting device. A cooperating latch 44, having a lead-in chamfered surface 46, projects outwardly from each flexible wall 40. As will be seen hereinafter, latches 44 are provided for cooperating with latches on primary locking arms of connectors 12, and actuator posts 36 are provided for activating CPA device 16 so that the CPA device can move to its blocking position.

Figure 5:
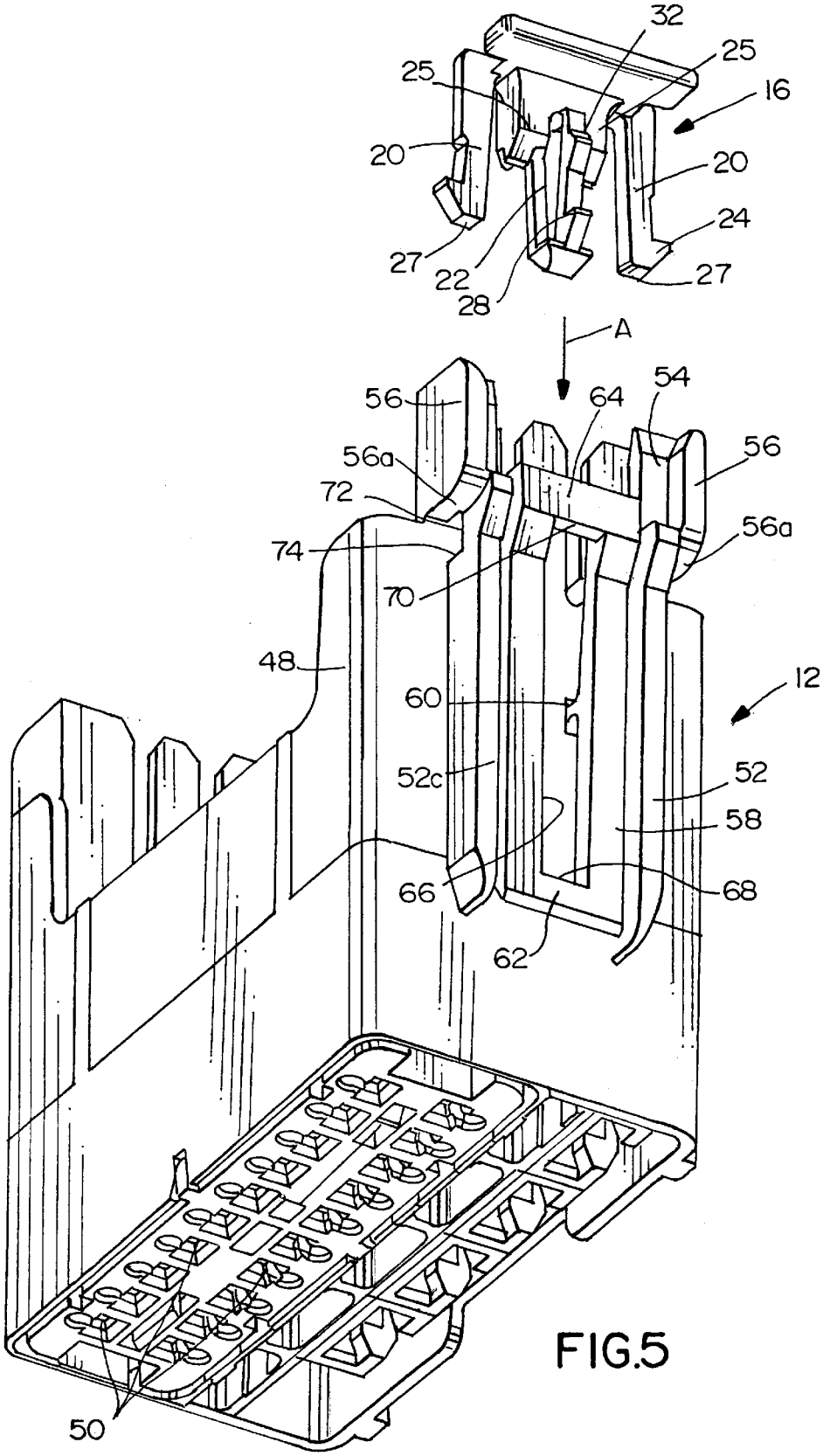
FIG. 5 is a perspective view of the CPA device removed from the connector.

Referring to FIG. 5 in conjunction with FIG. 1, connector 12 includes a housing 48 of dielectric material for mounting a plurality of terminals (not shown) in respective terminal-receiving cavities or passages 50. The housing may be molded of plastic material or the like. The housing has a guideway defined by a pair of laterally spaced guide rails 52 and a mouth 54 defined by a pair of laterally spaced guide rail flanges 56. A primary flexible locking arm 58 is pivotally mounted on a fulcrum 60 between or intermediate a front latch end 62 of the locking arm and a rear end 64 of the locking arm. A closed slot 66 extends between the opposite ends of the locking arm to define a front latch shoulder 68 and a rear positioning shoulder 70. Each guide rail 52 has an aperture 72 defining a stop surface 74. in FIGS. 1, 4 and 5, CPA device 16 is shown removed from connector 12, but the CPA device is mountable on its respective end of the connector housing 48 in the direction of arrows "A" until the CPA device is in its first or pre-load position shown in FIGS. 6 and 7.

Figure 6:
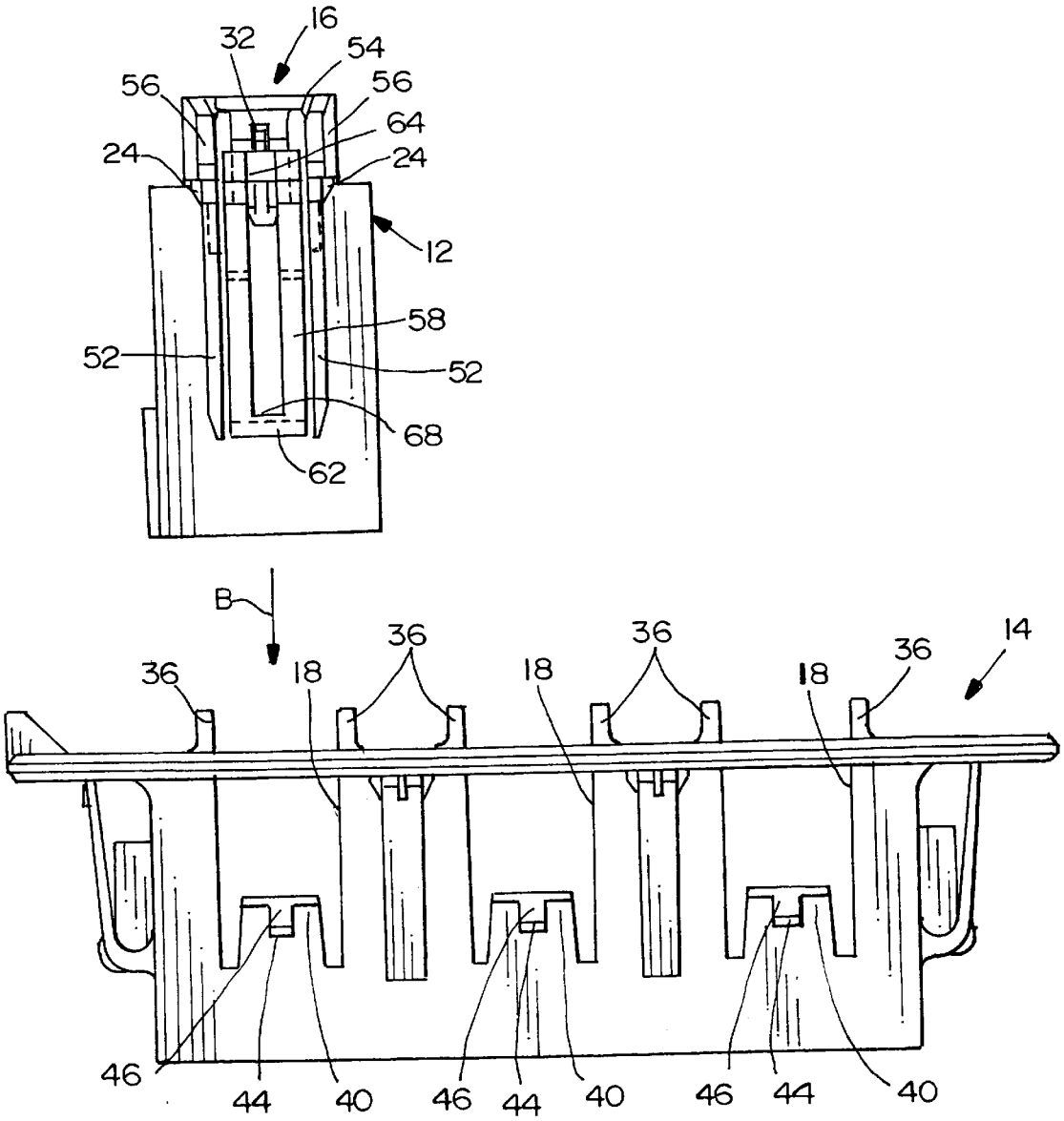
FIG. 6 is a side elevational view similar to that of FIG. 4, with the CPA device in its pre-load position on the connector.
Figure 7:
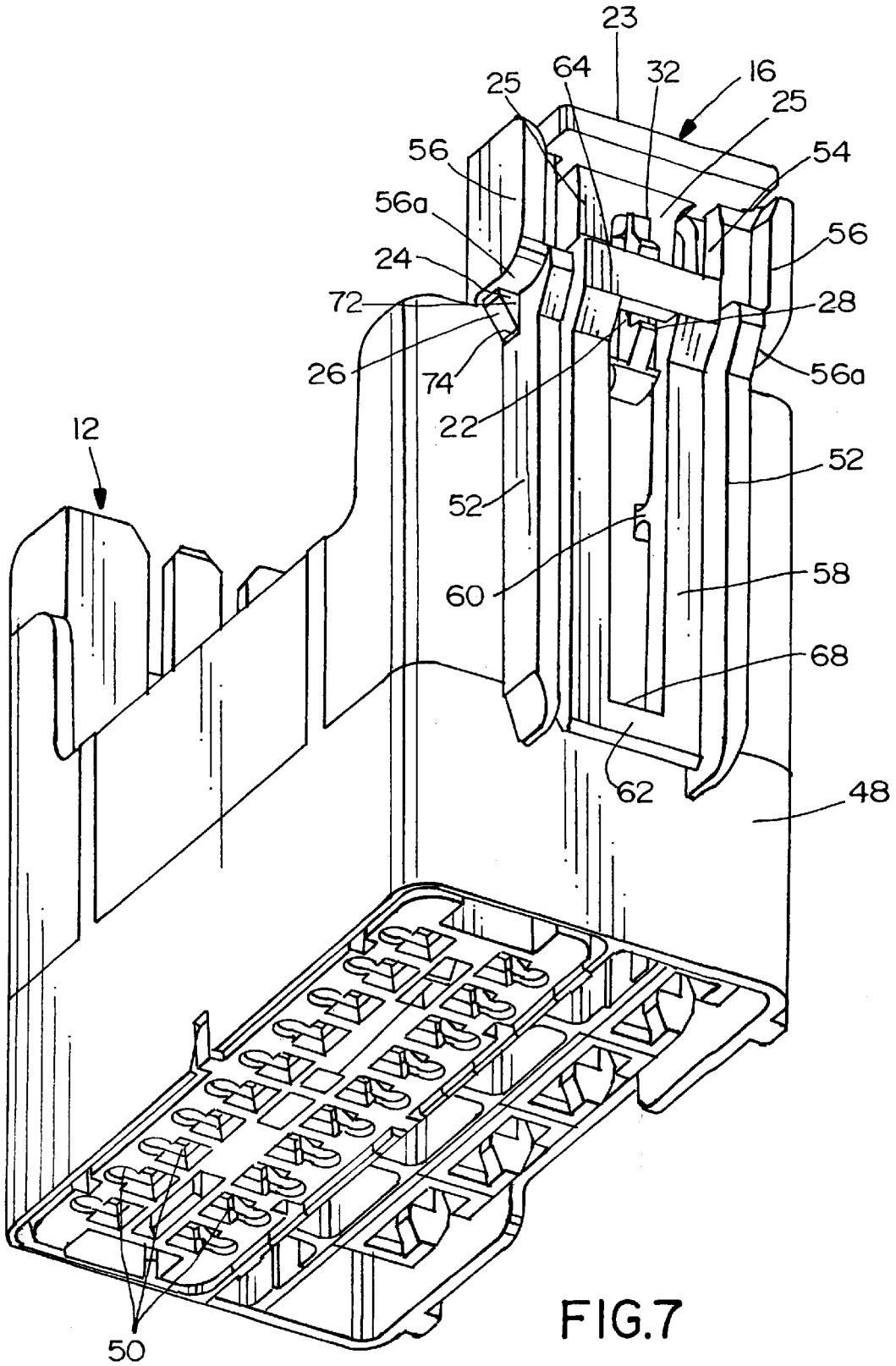
FIG. 7 is a perspective view of the CPA device in the pre-load position.

More particularly, in the pre-load position shown in FIGS. 6 and 7, CPA device 16 has been moved through mouth 54 and slidably between guide rail flanges 56 and guide rails 52. Outside legs 20 (FIGS. 2 and 3) of the CPA device define flexible stop arms thereof. When the CPA device is inserted into mouth 54, chamfered leading surfaces 26 latch hooks 24 engage the inside corners of guide rail flanges 56 to flex stop arms 20 inwardly until the latch hooks become aligned with apertures 72 in guide rails 58. The stop arms snap back outwardly as latch hooks 24 snap into apertures 72. This defines the pre-load position of CPA device 16. In the pre-load position, the CPA device cannot back out of mouth 54 because of the interengagement of latch hooks 24 with the bottom ends 56*a* of guide rail flanges 56 as clearly shown in FIG. 7. In addition, abrupt distal ends 27 (FIGS. 2 and 3) of flexible stop arms 20 engage stop surfaces 74 defined by apertures 72. This prevents the CPA device from being moved inwardly beyond its pre-load position. In other words, when latch hooks 24 snap into apertures 72 in guide rails 52, the CPA device cannot move either in or out of its pre-load position.

When in the pre-load position of the CPA device as best shown in FIG. 7, rear end 64 of primary locking arm 58 is disposed between latch hook 28 and raised boss 32 of center leg 22 of the CPA device. This allows free pivoting movement of primary locking arm 52 about fulcrum 60. In other words, either opposite end 62 or 64 of the primary locking arm can "teeter" about fulcrum 60 when the CPA device is in its pre-load position.

Figure 8:
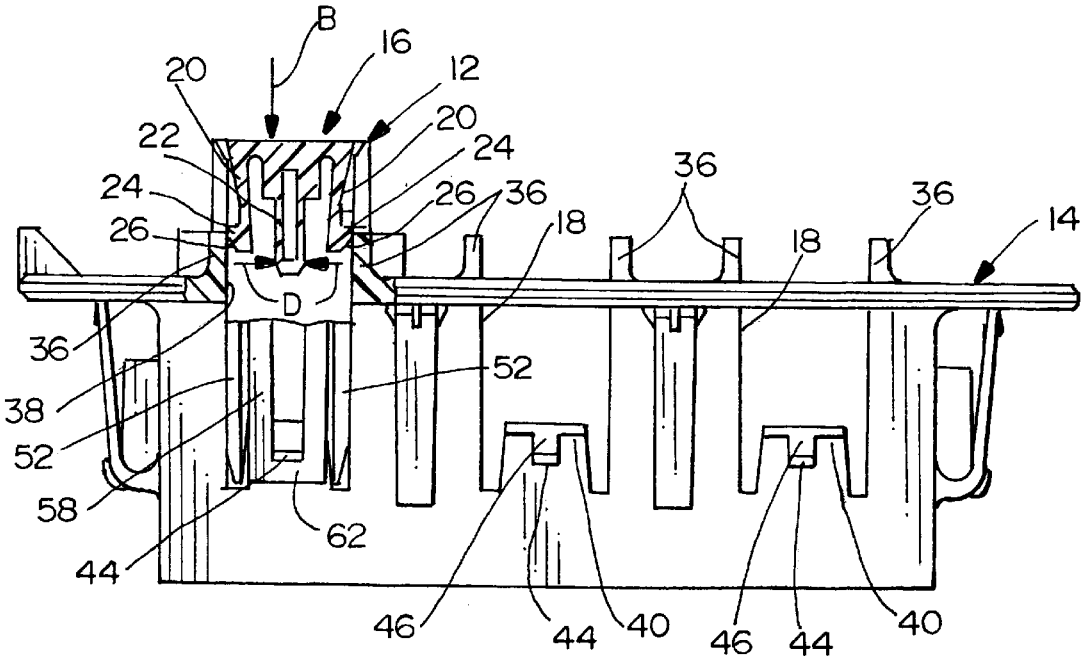
FIG. 8 is a side elevational view of the connector assembly, partially broken away and in section, to show the flexible stop arms of the CPA device being moved by the actuator posts of the mateable connecting device.

FIG. 8 shows connector 12 and CPA device 16 being moved further into its respective receptacle 18 (FIG. 1) of mateable connecting device 14 in the direction of arrow "B" When connector 12 is inserted into its respective receptacle 18 in mateable connecting device 14, and with CPA device 16 in its pre-load position, front latch end 62 of primary locking arm 52 snaps into mechanical interlocking engagement with cooperating latch 44 on the mateable connecting device. As the connector is inserted into its respective receptacle, it can be seen in FIG. 8 that actuator posts 36 engage chamfered surfaces 26 of latch hooks 24 which project outwardly from stop arms 20 of the CPA device. This causes the stop arms to be biased inwardly in the direction of arrows "D". When the latch hooks are biased inwardly, the latch hooks clear apertures 72 (FIG. 7) in guide rails 52, allowing the CPA device to move in the direction of arrow "E" (FIG. 9) to a second position blocking movement of primary locking arm 58 from its latched position.

Figure 9:
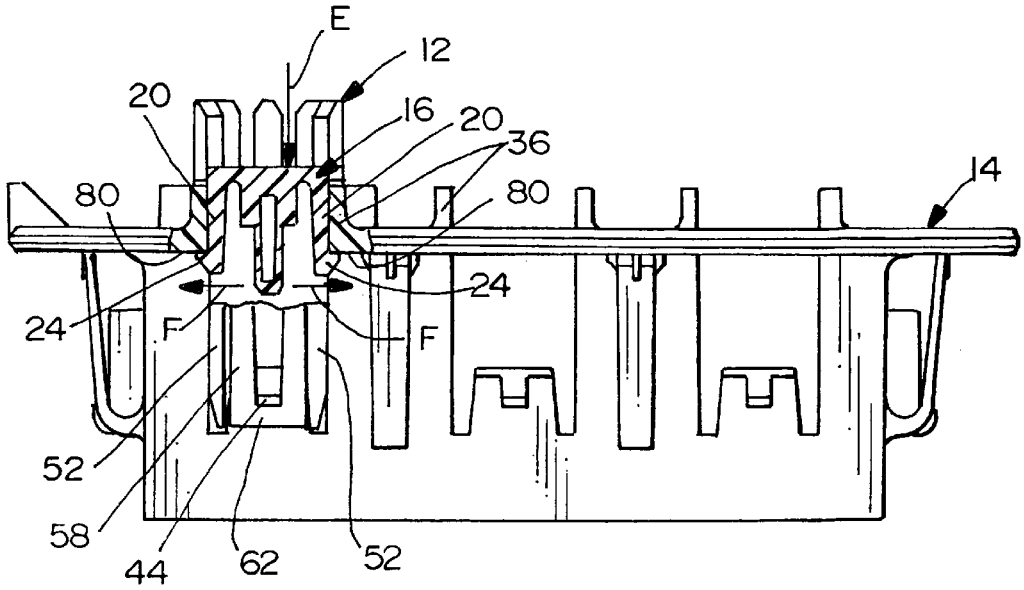
FIG. 9 is a view similar to that of FIG. 8, with the CPA device in its second or blocking position.

In the second or blocking position of CPA device 16 as shown in FIG. 9, flexible stop arms 20 remain biased inwardly in pockets 53 on the interior of guide rails 52 of connector 12. Latch hook 28 of center leg 22 of the CPA device also is disposed on the inside of rear end 64 of the primary locking arm. In this blocking position of the CPA device, raised boss 32 (FIG. 2) moves past rear end 64 of primary locking arm 58 whereby blocking surface 25 is positioned just behind rear end 64 which, in turn, prevents any pivoting movement of the locking arm about fulcrum 60. Therefore, with the CPA device in the position of FIG. 9, the primary locking arm is immobilized and completely blocked from unlatching movement away from complementary latch 44 of mateable connecting device 14. The connector can unmated only by applying a force, in a direction opposite arrow "A" (FIG. 5), to the CPA device at cross portion 23 to push raised boss 32 past rear end 64 and move the CPA device back to its pre-load position. In that position, front latch end 62 of primary locking arm 52 can be moved out of interlocking with latch 44 on the mateable connecting device by pushing on rear end 64 of the locking arm, whereupon the connector can be pulled out of its receptacle 18 in the mateable connecting device.

It will be understood that the invention may be embodied in other specific forms without departing from present spirit or central characteristics thereof. The present examples and embodiments, therefore, are to be considered in all respects as illustrative and not restrictive, and the invention is not to be limited to the details given herein.

We claim:

1. A connector position assurance system comprising:

an electrical connector including a housing having a guideway and at least one stop surface near the guideway;

a mateable connecting device for mating with the electrical connector;

a primary flexible locking arm on the connector housing and including a latch for mechanically interlocking with a cooperating latch of the mateable connecting device; and a connector position assurance (CPA) device slidably mounted on the housing for movement along said guideway between a first position allowing movement of the locking arm and mating of the connector with the mateable connecting device and a second position blocking movement of the locking arm away from the latched position, the CPA device including a flexible stop arm engageable with the stop surface on the housing to prevent the CPA device from moving from its first to its second position;

said mateable connecting device including an actuator for moving the flexible stop arm of the CPA device out of engagement with said stop surface when the connector is fully mated with the mateable connecting device thereby allowing movement of the CPA device from its first position to its second position indicating full mating of the connector, wherein said primary flexible locking arm is pivoted to the housing on a fulcrum between a front latch end and a rear end of the locking arm, and the CPA device includes detents engageable with the rear end of the locking arm to define the first and second positions of the CPA device.

2. The connector position assurance system of claim 1 wherein said primary flexible locking arm is pivoted to the housing on a fulcrum between a front latch end and a rear end of the locking arm, and the CPA device includes a blocking portion movable beneath the rear end of he locking arm when the CPA device is in its second position to prevent flexing of the front latch end of the locking arm.

3. The connector position assurance system of claim 1 wherein said guideway comprises a pair of guide rugs between which the CPA device slides.

4. The connector position assurance system of claim 3 wherein each of said guide rails includes one of said stop surfaces, the CPA device includes a pair of said flexible stop arms engageable with the stop surfaces, and the mateable connecting device includes a pair of said actuators for moving the stop arms out of engagement with the stop surfaces.

5. The connector position assurance system of claim 1 wherein said CPA device includes an enlarged flange for grasping by a user to facilitate manual manipulation of the CPA device.

6. A connector position assurance system comprising:

an electrical connector including a housing having a guideway defined by a pair of laterally spaced guide rails along with a pair of laterally spaced stop surfaces;

a mateable connecting device for mating with the electrical connector;

a primary flexible locking arm pivoted to the housing on a fulcrum between a front latch end and a rear end of the locking arm, the front latch end having a latch for mechanically interlocking with a cooperating latch of the mateable connecting device; and a generally E-shaped connector position assurance (CPA) device defining a pair of outside legs and a center leg extending from a blocking surface, the CPA device being slidably mounted on the housing generally between the guide rails for movement between a first position allowing movement of the locking arm and mating of the connector with the mateable connecting device and a second position wherein the blocking surface of the CPA device blocks movement of the locking arm away from a latched position, the outside legs of the E-shaped CPA device defining flexible stop arms engageable with said stop surfaces on the housing to prevent the CPA device from moving from its first to its second position;

said mateable connecting device including a pair of actuators for moving the flexible stop arms of the CPA device out of engagement with said stop surfaces when the connector is fully mated with the mateable connecting device thereby allowing movement of the CPA device from its first position to its second position indicating full mating of the connector, wherein said CPA device includes detents engageable with the rear end of the locking arm to define the first and second positions of the CPA device.

7. The connector position assurance system of claim 6 wherein said center leg of the E-shaped CPA device includes a blocking portion movable beneath the rear end of the locking arm when the CPA device is in its second position to prevent flexing of the front latch end of the locking arm.

8. The connector position assurance system of claim 6 wherein said CPA device includes an enlarged flange for grasping by a user to facilitate manual manipulation of the CPA device.

* * * * *